US005259556A

United States Patent [19]

Paige et al.

[11] Patent Number: 5,259,556

[45] Date of Patent: * Nov. 9, 1993

[54] PRESSURE WASHER WITH PRESSURE BYPASS

[75] Inventors: Clive Paige, Berkshire, England; Robert C. Berfield, Jersey Shore, Pa.

[73] Assignee: Shop-Vac Corporation, Williamsport, Pa.

[ * ] Notice: The portion of the term of this patent subsequent to Feb. 11, 2009 has been disclaimed.

[21] Appl. No.: 819,351

[22] Filed: Jan. 15, 1992

Related U.S. Application Data

[63] Continuation-in-part of Ser. No. 634,063, Dec. 26, 1990, Pat. No. 5,086,975, which is a continuation of Ser. No. 462,733, Jan. 9, 1990, abandoned, which is a continuation-in-part of Ser. No. 297,620, Jan. 17, 1989, abandoned.

[51] Int. Cl.[5] ..... F04B 17/00

[52] U.S. Cl. ..... 239/124; 239/571

[58] Field of Search ..... 137/509, 566, 569, 567; 239/572; 417/440, 539; 92/167, 240

[56] References Cited

U.S. PATENT DOCUMENTS

| | | | |
|---|---|---|---|
| 2,018,119 | 10/1935 | Brouse | 137/117 X |
| 4,172,468 | 10/1979 | Ruus | 137/509 X |
| 4,497,440 | 2/1985 | Galloway | 137/509 X |
| 4,611,628 | 9/1986 | Pasternack | 137/509 |
| 4,941,502 | 7/1990 | Loos et al. | 137/569 X |

*Primary Examiner*—Andres Kashnikow
*Assistant Examiner*—Kevin Weldon
*Attorney, Agent, or Firm*—Marshall, O'Toole, Gerstein Murray & Borun

[57] ABSTRACT

A pressure washer for delivering a liquid under high pressure has an inlet conduit connected to a liquid supply and an outlet conduit connected to a spray nozzle which can be operated to control the delivery of liquid through the nozzle. A bypass conduit enables recirculation of the liquid from the outlet conduit to the inlet conduit. A bypass system, disposed between the outlet conduit and the bypass conduit, includes a shuttle valve which moves between first and second positions at which it respectively blocks or opens the liquid path from the outlet conduit to the bypass conduit. The shuttle includes an axial passage from its inlet to its outlet side which passage has a narrowed jet outlet such that, when the liquid flows through the spray nozzle and the outlet conduit, the pressure drop across the shuttle moves the shuttle to the first position, while when the flow out the spray nozzle is stopped or significantly blocked, pressure on the side of the shuttle facing the spray nozzle rises to the level at the inlet side of the shuttle, which moves the shuttle to unblock the bypass conduit. A spring aids the return motion of the shuttle to the second position.

13 Claims, 3 Drawing Sheets

PRESSURE WASHER WITH PRESSURE BYPASS

CROSS REFERENCE TO RELATED APPLICATIONS

This is a continuation in part of U.S. patent application Ser. No. 07/634,063, filed Dec. 26, 1990, now U.S. Pat. No. 5,086,975 which is a continuation of U.S. patent application Ser. No. 07/462,733, filed Jan. 19, 1990, now abandoned, which is a Continuation-In-Part of U.S. patent application Ser. No. 07/297,620, filed Jan. 17, 1989, now abandoned.

BACKGROUND OF THE INVENTION

Generally, the present invention relates to a pressure washer which pumps liquid from an external source and supplies it to a spray nozzle at high pressure, typically even higher than 1,000 psi. More specifically, the invention relates to a bypass system, disposed between the liquid outlet and the liquid inlet of the pump of the pressure washer. The bypass system serves to regulate or relieve the pressure at the liquid outlet of the pump, both when the pressure washer is operating and the pump is pumping and when the pump is turned off. The system of the present invention prevents over-pressurization of the liquid at the liquid outlet and avoids the possibility that an undesirable initial burst of pressurized liquid will shoot through the spray nozzle, should the spray nozzle be turned on while the pump is off.

The pressure washer of the present invention may be embodied in a standing or portable version. In the standing version, a pumping section of the washer stands on the floor and has an elongated hose leading to a hand-held spray nozzle. The pathway through which the liquid is pumped to the spray nozzle is selectively openable to permit the liquid to be sprayed from the spray nozzle and closable to halt the spray of liquid. The portable version is, on the other hand, comprised of a single, portable, hand-held unit combining the nozzle with the pumping unit.

Some pumps are designed to operate only when liquid spraying is required. In the standing form of the pressure washer, on the other hand, the pump is typically operated continuously whether the liquid pathway to the spray nozzle is open or closed. Consequently, the standing pressure washer requires protection of the pump from overheating and other effects when the liquid pathway which is controlled by the spray nozzle is closed while the pumping action continues. Another type of protection is against excess pressure in the system downstream of the pump, due, for instance, to a blockage. One known technique for protecting the continuous pumping washer system comprises selective bypassing of pumped liquid from the pump outlet back to the pump inlet when the liquid pathway is closed. A valve controls the bypass arrangement to permit bypass recirculation at a lower pressure to prevent overheating of the pump elements.

However, even in a pressure washer in which the pump is turned off when liquid spraying is halted, a problem exists in conventional pumps in that the pump motor shuts down gradually, not instantly. As a result, with the pump motor off and the spray nozzle closed, the gradual stopping of the pump motor has the effect of pressurizing the output chamber of the pressure washer, with the undesirable result that when the spray nozzle is actuated while the pump is off, there is an initial burst of highly pressurized liquid through the nozzle.

Further, often the pressure washer is used to pump liquid, particularly water at high pressure. When the water is used for cleaning purposes, it is sometimes desired to mix with it another liquid, for example, a detergent, a chemical, or the like. Appropriate mixing means are then needed for controllably mixing the additional liquid with the water being pumped. Various such mixing means are known in the art, but conventionally these known mixing devices have been provided separately and independently of the aforementioned bypass system. This complicates the construction and adds to the cost of pressure washers.

Many known pressure washers use piston/cylinder pumps, in which the piston is reciprocated by various means. It is further known and preferred to provide multi-piston pumps to optimize the balance, speed, torque, bearing life, valve design, flow rate, efficiency, and the spray characteristics, e.g. spray continuity and uniformity, of the pressure washer. In one multi-piston pump, the pistons are driven in a manner wherein they tend to wobble or swash as they reciprocate within their cylinders and move past a stationary resilient seal. It is therefore essential to provide a piston sealing arrangement which can withstand the wobbling/swashing of the pistons while still providing good sealing and a simple and easy to service piston sealing construction.

SUMMARY OF THE INVENTION

It is an object of the present invention to provide a pressure washer for pumping liquid through a spray nozzle at elevated pressures.

It is another object of the invention to provide a pressure washer which is able to develop and maintain correct pressure conditions in the outlet conduit leading to the spray nozzle of the washer, while the washer is operating and also when it is turned off.

A still further object of the invention is to provide a simplified bypass system in a pressure washer in which the same unit has the ability to both bypass liquid from the outlet conduit to the inlet conduit of the pressure washer and to mix additional liquid with the liquid being pumped.

The foregoing and other objects of the present invention are realized by a pressure washer which is capable of delivering liquid under pressure. The pressure washer of the present invention includes a spray nozzle for spraying liquid, an outlet conduit connected for delivering liquid to the spray nozzle and an inlet conduit for receiving liquid from a liquid supply. A pump, preferably a multi-piston pump, is connected between the inlet conduit and the outlet conduit and is effective for pumping liquid from the inlet conduit to the outlet conduit.

The spray nozzle has associated with it actuation means which enable selective opening and blocking of the exit of liquid pumped by the pump from the spray nozzle. A bypass conduit connected between the inlet conduit and the outlet conduit is disposed in parallel with the pump.

A liquid bypass system is associated with the bypass conduit and permits selective closing and opening of the bypass conduit. The bypass system includes a bypass chamber which is in liquid communication with the bypass conduit. The bypass chamber has a chamber inlet in liquid communication with the outlet conduit, a main chamber outlet in liquid communication with the spray nozzle and a separate bypass chamber outlet to the bypass conduit. A valve shuttle moves in the bypass chamber between first and second positions. In the first forward position of the shuttle, the shuttle blocks fluid communication between the bypass chamber and the bypass conduit, while in the second rearward position, the shuttle enables fluid communication between the bypass chamber and the bypass conduit.

The shuttle has a first surface area which is exposed to liquid pressure at the chamber inlet side of the shuttle and a second surface area which is exposed to liquid pressure at the main chamber outlet side of the shuttle. The first and second surface areas of the shuttle and the shuttle itself are so constructed and dimensioned that the first inlet side surface area is smaller than the second outlet side surface area whereby when the force on both ends of the shuttle is the same, the differences in the first and second surface areas urges the piston rearwardly in the bypass chamber.

To assure that rearward motion, in addition to the above described pressure differential, biasing means normally urge the shuttle to its rearward position, at which bypassing can occur. This is a safety measure because if bypassing does not occur due to the shuttle not shifting fast enough or not shifting under the pressure differential, the liquid pump will overheat as it is pumping liquid that will not move.

A liquid flow passage passes axially, i.e., longitudinally, through the shuttle from the first to the second surface area thereof. The passage is narrowed such that there is a higher pressure jet flow from the small passage outlet. Preferably, the passage has a first larger cross-section opening into its upstream end at the first surface and tapers gradually narrower to a second smaller cross-section opening at its outlet end at the second surface. The reduced cross-section of the passage inherently causes a pressure drop through the shuttle channel, and a jet of liquid will exit through the second surface. The decreasing cross-section of the passage ending at a narrowed exit more efficiently produces a pressure drop than might a longer uniformly narrow passage. This inherent pressure drop has a valuable function, described below.

The shuttle has a substantially circular external cross-section. It has first and second seals which are disposed longitudinally spaced apart along the length of the shuttle. Each seal extends circumferentially around the shuttle and defines the periphery of the shuttle and the cross-section of the shuttle at the seal. The first seal seals the bypass chamber inlet from the bypass conduit in the first position of the shuttle but opens communication between the bypass chamber inlet and the bypass conduit in the second position of the shuttle. The second seal seals the chamber outlet from the bypass conduit in all positions of the shuttle. The shuttle periphery defines a first smaller cross-section for the first rearwardly facing surface area of the shuttle which faces the inlet conduit. The shuttle periphery defines a second larger cross-section area for the second forwardly facing surface area of the shuttle which faces the outlet conduit.

In a preferred embodiment, the bypass chamber has first, second and third axially or longitudinally extending regions. The first region is toward the inlet side of the chamber and the smaller diameter or smaller cross section first shuttle surface area faces toward the first region. The second region is toward the outlet side of the chamber and the larger diameter or larger cross section second shuttle surface area faces toward the second region. The third region is disposed axially between the first and second regions. The bypass conduit is in fluid communication with the third region in the bypass chamber.

The first seal is located on the shuttle such that it is moved into the first region of the bypass chamber or out of the first region and toward the third region as the shuttle changes positions axially. The first seal has the same cross section as and is in sliding contact with the side wall of the bypass chamber between the first and the third regions to seal the inlet conduit from the bypass conduit when the shuttle is forward in the first position. The communication between the inlet and the bypass conduit is open when the first seal is in the first bypass chamber region. The second seal is so located on the shuttle and the second seal has the same cross section as and is at all times in sliding contact with the side wall of the bypass chamber between the second and third regions in the bypass chamber.

In a further developed version of the bypass system of the invention, a further liquid conduit debouches into the bypass chamber at the third region for enabling introduction into the bypass chamber of an additional fluid like a detergent or other chemical for being mixed with the liquid that has not been bypassed but that has been pumped to the outlet by the pressure washer pump. The conduit from the bypass chamber outlet may define a venturi which sucks in the additional fluid.

Other features and advantages of the present invention will become apparent from the following description of the invention which refers to the accompanying drawings.

DETAILED DESCRIPTION OF THE DRAWINGS

Figure 1:
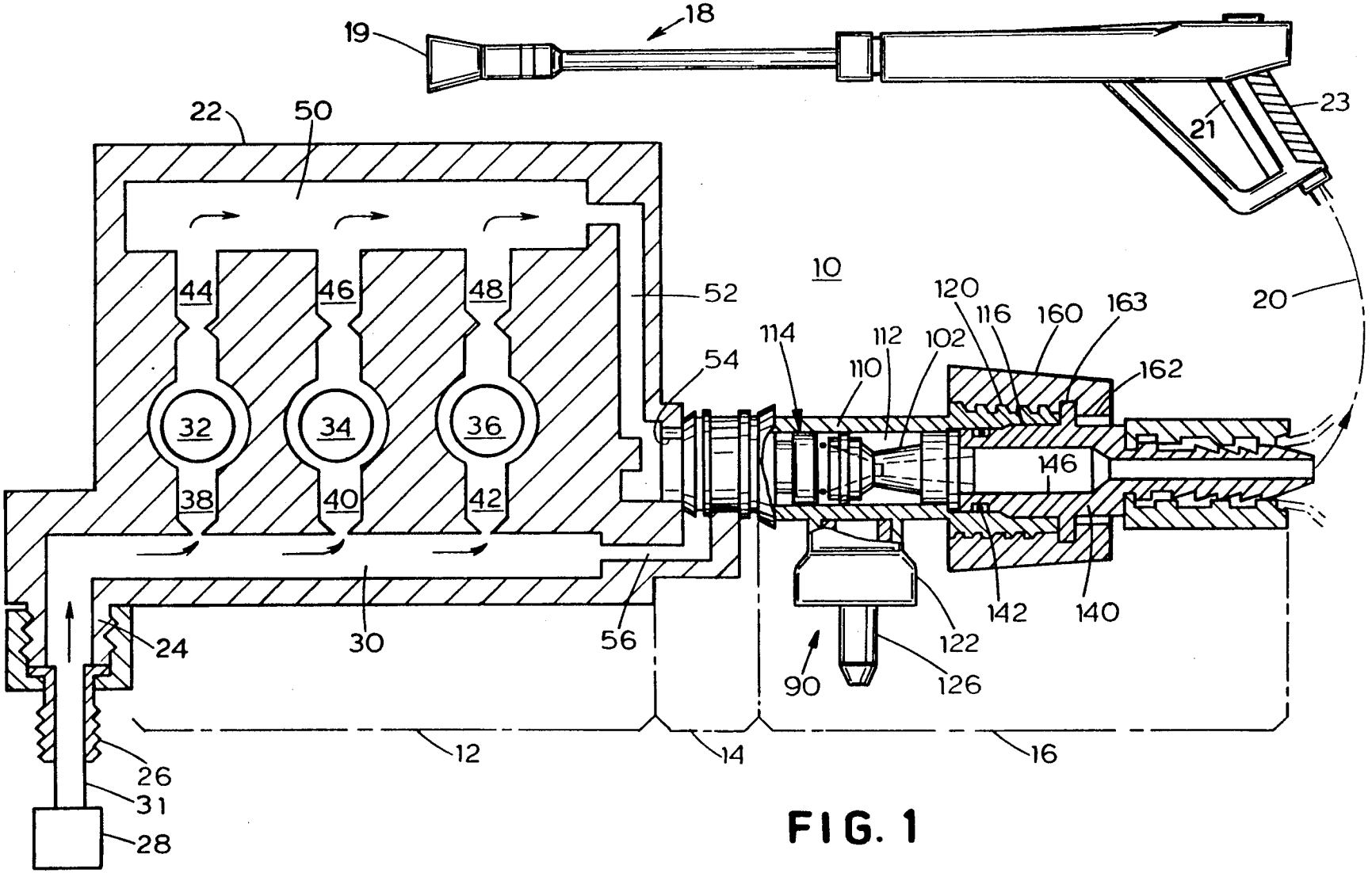
FIG. 1 is a schematic longitudinal cross-section in plan view of a pressure washer according to the present invention.

Referring to FIG. 1, a pressure washer 10 in accordance with the present invention essentially comprises a pump module 12 for delivering liquid at an elevated pressure to a spray gun and hose assembly 18, through a combined bypass and chemical injection system 14 and a hose coupling section 16.

The entire pressure washer 10 can be embodied as a single, hand-held, portable unit, with the spray gun assembly 18 mechanically and essentially inflexibly secured to the section 16, in a manner which allows an operator to carry the entire unit to a location where spraying of articles or material with liquid is needed.

Alternatively, the pressure washer 10 of the present invention may be embodied in a standing version. In the standing version, the pumping module 12, bypass system 14, and hose coupling section are in one housing 22 which stands on the floor, and an elongate hose 20 leads to the hand held spray gun assembly 18.

The pumping module 12 is essentially disposed within a block or housing 22. The housing 22 has an inlet fitting 24 which receives a coupling 26 that is connectable with a supply 28 of wash liquid, typically water. The liquid supply 28 may be the water tap of a conventional water supply or a hose 31 leading from a reservoir 28.

The inlet fitting 24 has a liquid channel which communicates into a common inlet conduit 30 which supplies each of the three below described pumping cylinders 32, 34, and 36 with water, each cylinder being supplied through its respective input conduit 38, 40 and 42. Each cylinder 32, 34, 36 also has a respective output conduit 44, 46, 48 which leads into a common outlet conduit 50. The three cylinders 32, 34, and 36 are connected in parallel with one another, extending between the inlet conduit 30 and the outlet conduit 50. Since the wash liquid is pumped through all three cylinders to the outlet conduit 50, a significant pumping pressure is developed and other advantages are obtained as well, e.g., optimized balance, speed, torque, bearing life, valve design, flow rate, efficiency, and spray continuity and uniformity.

The pressurized wash liquid in the outlet conduit 50 is thereafter directed through a further, L-shaped conduit 52 to an inlet chamber portion 54 of the bypass system 14.

The bypass system 14 serves to divert pumped wash liquid from outlet conduit 50 of the pump module 12 to a bypass conduit 56 which leads back to the low pressure inlet conduit 30 of the pump 12.

Figures 2, 3:
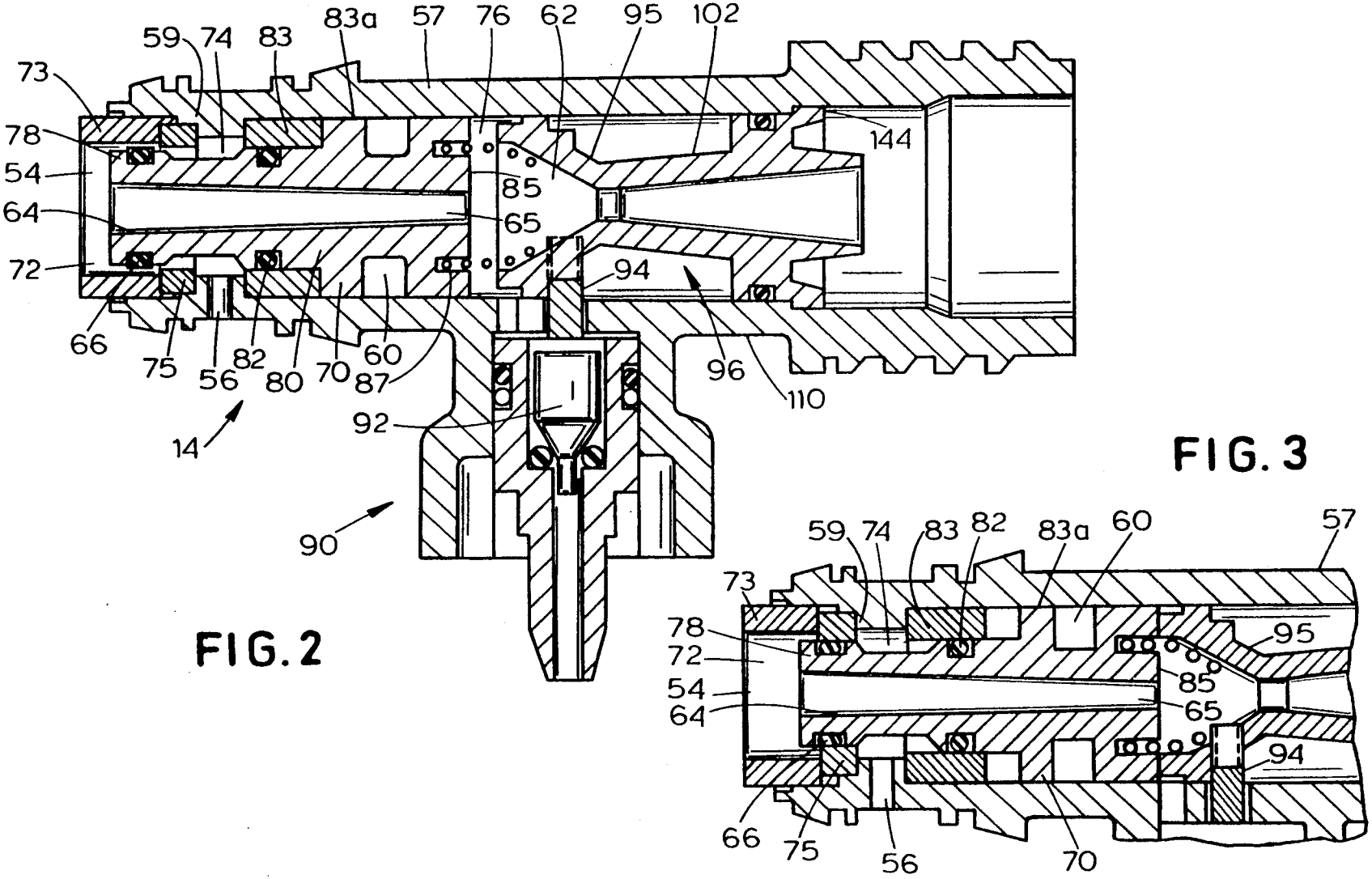
FIG. 2 is a cross-section through a bypass valve located between the outlet and the inlet of the pressure washer and with a shuttle of the bypass valve in a first position.
FIG. 3 shows the bypass valve of FIG. 2 with the shuttle in a second position.

Referring to FIGS. 2 and 3, the bypass system 14 is described. It includes an external annular housing 57 which surrounds and defines a bypass chamber 60 through which wash liquid flows from the conduit 52 into the bypass chamber first region 72, then through a liquid passage 64 which has a tapering narrower cross-section and terminates in the narrower cross-section outlet 65 in the second region 76 toward the outlet conduit 62. The passage 64 is formed in below described shuttle valve element 70. From the outlet conduit 62 of the bypass system 14, the pumped and not bypassed liquid flows to the gun assembly 18 and exits from the nozzle 19 thereof when the hand operated trigger 23 is actuated (FIG. 1).

The shuttle 70 is a piston, which is axially movable along the bypass chamber 60. The axially extending always open passage 64 enables liquid to flow through itself to or from the outlet conduit 62 in all positions of the shuttle 70. On the other hand, the shuttle 70 is capable of either sealing off or enabling liquid flow from the inlet conduit 52 to the bypass conduit 56.

In the bypass conduit blocking position, the shuttle 70 is disposed in a first forward position nearer the outlet conduit 62, as shown in FIG. 3. In that position, a first circumferential seal 66, e.g. an O-ring or the like, supported in an annular groove of the shuttle 70 engages a block 75 in the housing around the seal 66 and seals the bypass conduit 56 from the inlet chamber 54. In its second rear position shown in FIG. 2, the shuttle 70 is moved toward the inlet conduit 52 and opens communication between the inlet chamber 54 and the bypass conduit 56.

The housing 57 has an annular interior 58 of generally uniform internal cross-section. However, there is an internal annular collar 59 with axially opposite shoulders at the bypass conduit 56. The bypass chamber 60 in the housing 57 has three regions spaced axially along it. A first rearward region 72 of the chamber 60 is disposed toward the inlet conduit 52 and at the inlet chamber 54. It has an intermediate diameter which is defined by the annular insert 73 which is installed in the housing 57 and surrounds the region 72. The forward end of the first region 72 is defined by the annular O-ring 66 when the seal meets and seals against the rearward seal block 75 that is disposed in the housing 57 between the first region 72 and the third region 74. The seal block 75 is held in a groove in the housing 57 rearward of the collar 59. The seal block 75 has an internal diameter set to the external diameter of the O-ring seal 66 in the shuttle 70 when the shuttle is in its forward position of FIG. 3, to sealingly engage the seal block 75 and the seal 66.

The second, forward region 76, which is disposed toward the outlet conduit 62, has the internal diameter of the housing 57. That diameter is larger than the diameter of the seal 66 at the seal block 75. The region 76 would be mostly sealed at the end of the shuttle 70, but leakage toward the bypass conduit 56 is sealed off at the second seal O-ring 82.

The third region 74 is located along the shuttle between the other two regions 72 and 76. The region 74 is bounded axially by the first and second seal O-rings 66 and 82. The bypass conduit 56 communicates out of the bypass chamber 60 at the third region 74.

The shuttle 70 has a first annular ridge 78 which has a groove in it that supports and disposes the first seal 66 against the interior of the seal block 75 in the first forward position of the shuttle 70 but not in the second rearward position of the shuttle. The first seal 66 and the cooperating seal block 75 are designed so that the seal ring either slides over and provides a seal against the interior surface of the seal block 75, in the first forward position shown in FIG. 3, or so that it moves through and faces but is radially spaced from the interior surface of the first region 72, in the second rearward position shown in FIG. 2.

Toward its axial middle, the shuttle 70 has a second annular ridge 80 which supports the second circumferential seal ring 82. The second seal ring 82 continuously seals against the annular seal block 83 affixed on the inside of the housing 57 as the shuttle 70 and the seal 82 move back and forth. The seal block 83 serves another purpose. As shown in FIG. 2, the shuttle can move rearward, or to the left, until its collar 83*a* abuts the forward facing end of the seal block 83. This establishes the extent to which the shuttle can return rearward.

Axially beyond the collar 83*a*, the shuttle 70 widens to the full cross-section of the second forward region 76. At its forward end 85, the shuttle is at the full diameter of that region 76 and that end 85 is exposed to the pressure there. There may be some leakage flow past the shuttle end 85 and past the side of the shuttle. It is blocked at the seal 82 and has no effect on the pressure caused motion of the shuttle.

The diameter of the forward end 85 of the shuttle 70, which defines its cross sectional area, is greater than the diameter of the first seal 66 which defines the cross-sectional area of the rear end of the shuttle. If the pressure at both end surfaces of the shuttle is the same, the shuttle should always move rearward to the second position of FIG. 2. There are occasions when the shuttle should not move rearward. Those occasions are discussed below. But to assure that the shuttle moves rearward when it should, there is a spring 87 extending between a groove in the forward end 85 of the shuttle and the throat 95 of the venturi at the chemical injector inlet 90, discussed below. The spring 87 is tensioned by compression as the shuttle is moved forward, and the spring normally urges the shuttle rearward. The spring establishes the maximum extent to which the shuttle can move forward or to the right.

As shown in FIGS. 2 and 3, the passage 64 through the shuttle 70 has a wider cross-section first end toward the inlet side at the first region 72 of the chamber, and the passage 64 has a narrower cross-section second end region 65 toward the outlet at the second region 76 of the chamber. The narrowing of the passage 64 causes a pressure drop through the passage 64 and across the shuttle and produces a jet to exit at the forward surface 85 of the shuttle, past the narrowed cross-section end 65 and into the bypass chamber second region 76. The pressure drop reduces the fluid pressure in the second region 76 of the chamber as compared with the pressure in the first region 72. The passage end 65 is narrowed so that the jet exiting from it produces a sufficient pressure differential between the first surface area defined by seal 66 and the second surface area at end 85 so as to urge the shuttle 70 to shift rearwardly to the position of FIG. 2 when the outlet flow through the conduit 62 is blocked, as occurs when the pumped liquid outlet is closed while the pump is still operating. The shuttle is assisted to move rearwardly by the spring 87 because if the shuttle fails to move rearwardly bypass of the pumped liquid is prevented and the pump will soon be overworked and damaged. Operation of the shuttle is now described.

When the trigger 21 of the gun assembly 18 is actuated, the wash liquid is freed to escape from the outlet conduit 62. Were the passage 64 of uniform cross-section along its length and of large enough cross-section, the pressure in the entire bypass chamber 60, on both axial sides of the shuttle 70, in both first and second chamber regions 72 and 76, would be the same, and the shuttle would be pushed rearward to the second position of FIG. 3 because the area of the surface 85 is greater than the area defined by the seal 66. But because the end 65 of the passage 64 is narrowed, the flow through the passage produces a pressure drop across the shuttle, so that the pressure in the inlet region 72 is greater than that in the outlet region 76. Despite the differences in the surface areas of both ends of the shuttle and despite the spring 87 which biases the shuttle, the shuttle 70 is moved forward to the position in FIG. 3 by the liquid pressure behind it over the opposition of spring 87, which is therefore weak enough. This places the first seal 66 at the seal block 75 and thus blocks off the bypass outlet 56. Wash liquid then flows only through the passage 64 to the outlet conduit 62.

In this mode, the liquid is accelerated in the narrowing passage 64 and exits through the outlet conduit 62.

When the trigger 21 is released, the outlet conduit 62 is closed. As no liquid flows out of the conduit 62, no liquid flows through the passage 64. There is no pressure drop across the shuttle. The respective pressures at the opposite longitudinal ends of the shuttle 70 quickly become identical, because there is no liquid flow out the conduit 62. However, since the front surface area 85 of the shuttle 70 is larger than the rear surface area at the seal 66 at the rear of the shuttle 70, the same pressure applied to the different surface area ends of the shuttle causes a thrust imbalance across the shuttle 70 and urges the shuttle rearward to the position shown in FIG. 2, with the positive assistance of the bias of the spring 87.

In the rearward shuttle position shown in FIG. 2, the first seal 66 is at an axial position where it is spaced from the interior wall of the chamber 60 in the region 72. This allows wash liquid to pass around the side of the shuttle 70 and into the bypass conduit 56 so that it can recirculate through the pump cylinders 32, 34 and 36.

Not only does the shuttle play an important role upon the spray gun spraying and not spraying, it also reduces the stored pressure behind the spray gun valve when the pump is turned off after the spray gun outlet has been closed. Normally, that closure would leave a high pressure head behind the spray gun valve and in front of the pump. A user would not know there is a danger that operation of the trigger with the pump off would still cause an immediate high pressure spurt through the spray nozzle, and that spray could hurt someone or something in its path. With the shuttle of the invention, when spraying stops and the pump is off, the pressure head behind the spray gun valve in a static non-flow situation will cooperate with the bias of the spring 87 to drive the shuttle 70 to the rear position of FIG. 3, far enough to open the path to the bypass conduit 56 back through the passage 64 and the chamber region 72. That will drain off enough pressure from the conduit 62 to prevent a dangerous spray in the inoperative condition of the spray gun.

The shuttle also compensates for excess pressure or unexpected bursts of pressure by the pump or for blockages somewhere in the passage through the outlet conduit 62 due, for instance, to dirt in the wash liquid that lodges in the pathway. This will reduce the cross-section of the path out of the bypass chamber, increase the pressure in the second downstream chamber region 76 and drive the shuttle 70 rearward, which also opens the path to the bypass conduit out of the first upstream chamber region 72. The pump thereby never has to pump into high counterpressure and the pump will therefore not be damaged through any of the unexpected variations in pumping and spraying conditions.

Thus, the bypass system 14 of the present invention realizes the primary aim of the invention in that wash liquid is bypassed from the outlet conduit 50 to the inlet conduit 30, through the bypass conduit 56, whenever the path of liquid from the outlet conduit 62 is closed or is blocked in part or totally or, in other words, whenever the liquid pressure at the outlet conduit 62 is equal to or greater than the liquid pressure in the inlet conduit 52. For example, after the trigger 21 is released, the gradual stopping of the motor will not result in an excessive build up of liquid pressure in the outlet conduit 62 which could cause a subsequent undesired, unexpected initial burst of pressurized liquid from the nozzle on the next occasion when the trigger 21 is actuated.

The bypass system depicted in FIGS. 2 and 3 does not require that the shuttle 70 have a circular cross-section. The bypass chamber 60 and the shuttle 70 could have a square, rectangular or any other cross-sectional shape, although sealing of the bypass conduit 56 is easier with a shuttle 70 having a circular or elliptical cross-section.

FIG. 3 illustrates a further development of the outlet conduit from the bypass system 14 which includes a chemical injection system 90 by which fluid, such as a chemical, a detergent, etc., may be injected through a one-way valve 92 into a conduit 94 which leads into the throat 95 which defines the beginning of a venturi section 96. The diameter of the throat 95 narrows in the liquid flow direction and is followed by a widening diameter section 102.

Fluid travelling through the bypass system passage 64 at considerable speed causes a drop in pressure in the venturi section 96 where the fluid flows as a jet stream after it exits the narrowed shuttle passage end 65. This causes chemicals to be drawn through the one-way valve 92 into the jet stream. In conventional chemical injection systems in which a separate chemical injection system is provided following the outlet of the pump, for proper operation, the difference in pressure between the liquid pressure developed by the pump and the pressure at a point located at the largest diameter cross-section of the liquid conduit outside the venturi has to be large enough to obtain a minimum required fluid velocity. This usually requires that the jet diameter of the liquid issuing from the pump be relatively small. However, this has the general disadvantage that it reduces the jet power at the nozzle when the chemical injector is not being used, i.e., at high pressure jetting. This effect is due to the pressure differential losses across the chemical injection jet. These losses have a smaller effect as the pressure increases and the flow rate is reduced.

However, in the present invention where the chemical injection system and the bypass system are combined, the jet from the chemical injection aids in developing the pressure differential for the shuttle operation and bypass losses are eliminated. This also removes the need for two jets and accompanying seals.

The shuttle 70 of the present invention also acts as an over-pressure venting device, should the outlet nozzle 19 in the gun assembly 18 become partly blocked. The shuttle design of the present invention prevents high pressure from developing at the outlet conduit 50 of the pump 12 under all conditions, including when the outlet nozzle has been closed intentionally or unintentionally or after the pump has stopped, an important safety feature.

While FIGS. 2 and 3 illustrate the concept of the bypass system, FIG. 1 illustrates an embodiment of the invention in which the housing 57 leads to a neck 110 which defines an internal chamber 112 in which the final part of bypass system 14 and a hose coupling described below are seated. The neck 110 defines a first bore 114 of a first diameter and a second larger diameter bore 116. The neck 110 is externally threaded at 120.

A hose coupling comprised of a block 140 is inserted into the chamber 112. The inlet end 142 of the block 140 abuts the outlet end of the venturi 102.

A ferrule 160 has a flange 162 which engages a cooperating annular collar 163 on the block 140. The ferrule is internally threaded and screwed on the threaded end of the neck 110, in a manner which secures the block 140 to the neck 110. The free end of the block 140 contains means for receiving and securing in place the end of the hose 20.

The gun assembly 18 comprises a liquid spraying device in the form of a gun having a handle 23 with a trigger 21 which can be actuated to permit high pressure fluid to flow through the gun for being sprayed on an article. The gun assembly 18 can be constructed to produce a plurality of different spraying patterns in accordance with the nozzle of U.S. Pat. No. 4,976,467. The contents of that patent are incorporated by reference herein.

Figure 4:
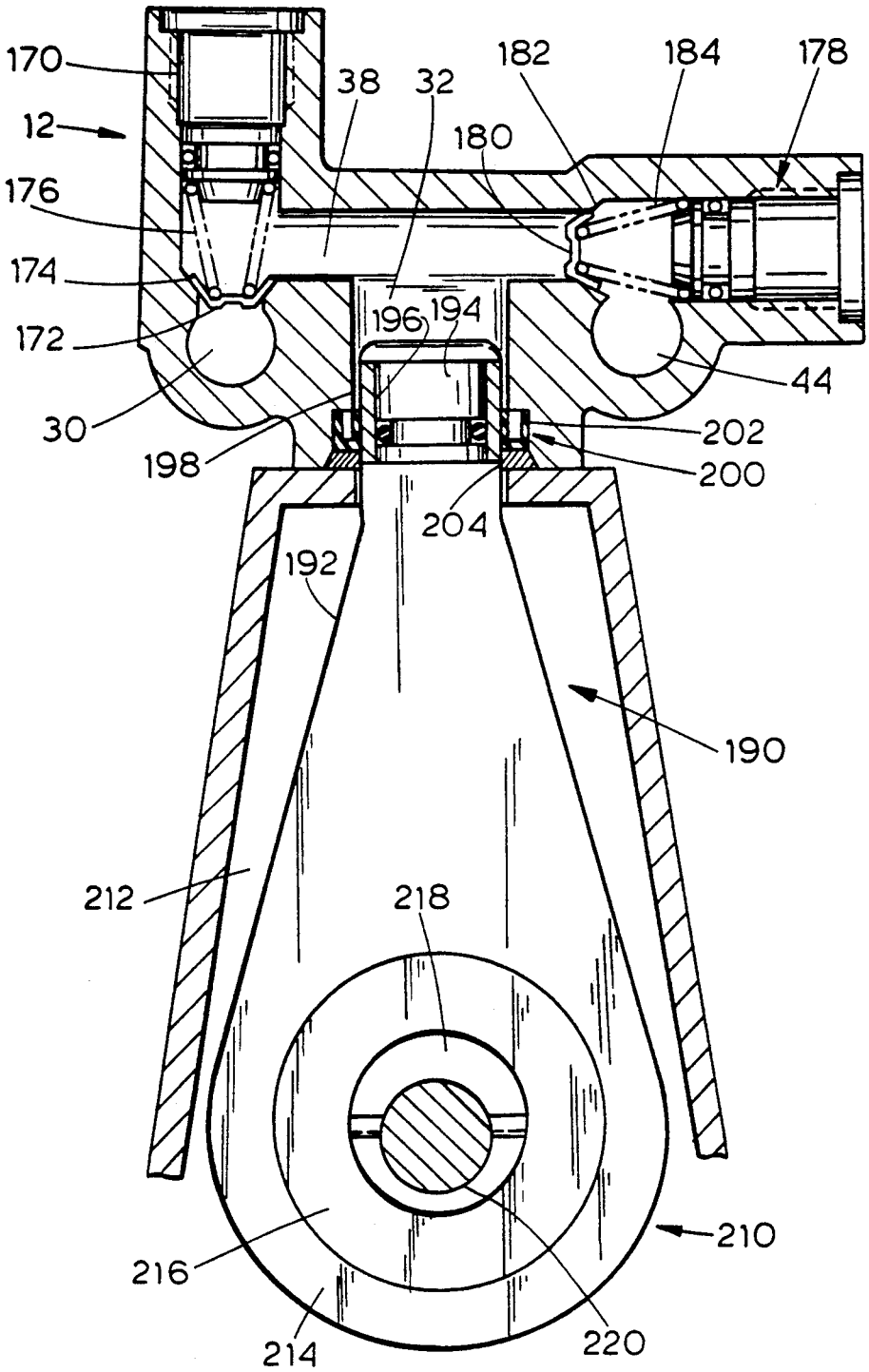
FIG. 4 is a cross-section through the pressure washer, showing one of the cylinders of the pump with a first type of seal arrangement.

As shown in FIG. 1, there are three pump cylinders 32, 34 and 36 which are identical in construction. One of them is now described by reference to FIG. 4. The embodiment of this cylinder described herein is the same as in the parent application of which this is a continuation in part and that description is incorporated herein by reference. The cylinder 32 communicates through the input conduit 38 with the inlet conduit 30. A one-way input valve 170 only permits the liquid to enter the cylinder 32 and the pressure in the cylinder 32 is reduced. When the pressure in the cylinder 32 is reduced, the pressure in the inlet conduit 30 presses upon the valve element 172 to raise it off its seat 174, and against the bias of the one-way return spring 176.

The output conduit 44 from the cylinder 32 to the outlet conduit 50 is also blocked by a one-way output valve 178. When the pressure in the cylinder 32 increases, the valve element 180 is raised off its seat 182, and against the bias of the spring 184 until the output conduit 44 communicates into the outlet conduit 50.

Pumping of liquid first into the cylinder 32 and then out of the cylinder is accomplished by the piston unit 190. It comprises the piston 192 with the head 194 that reciprocates in the cylinder 32. The piston head 194 is enclosed and surrounded by a cup-shaped cover 196 comprised of a smooth surface, but hard and durable ceramic material. The cover 196 is sized and shaped and the cylinder 32 is of a width that there are clearance spaces 198 along the sides of the piston head cover 196 to allow for the below-described lateral movement or wobble of the piston without the piston contacting the sides of the cylinder 32.

To seal the cylinder 32 around the wobbling piston head cover 196, particularly in view of the clearance spaces 198, the piston is surrounded by a static seal 200 comprising a U-shaped strip of resilient material with one leg normally biased inwardly against the side of the piston and the other leg held in the notch 202 below the cylinder block. The seal 202 is supported from below by the seal support 204 in the notch 202. The pressure inside the cylinder 32 forces the inward leg of the seal against the below-described cover 196 which surrounds the piston head 194.

The cover 196 slides over the piston head 194 and comprises its peripheral wall and presents a surface against which the seal 200 slides as the piston 190 reciprocates. The cover 196 contacting the seal 200 defines a fulcrum for pivoting of the piston 198, causing wobbling or lateral movement as the piston 192 reciprocates.

The piston unit 190 continues at piston rod 210 below the cylinder 32 into the housing 212 around it, as described below. The piston unit 190 is integral with the piston rod unit 210 which comprises the non-rotatable ring 214 at the bottom end of the rod of the piston 192, the ball bearing 216 within the ring 214, an eccentric bush 218 which rotates inside the bearing 216, and the rotating crank pin 220 at the center to which the bush 218 is secured.

Rotation of the crank pin 220 in turn rotates the respective eccentric bush 218. The eccentricity of the bush causes the ring to wobble eccentrically and that carries along the piston 192 so that the piston reciprocates up and down in the cylinder 32 and also wobbles left and right as it reciprocates up and down. The seal 202 around the piston cooperates with the cover 196 on the piston to prevent leakage through the clearance spaces 198 past the piston head 194.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A pressure washer for delivering liquid under pressure, the pressure washer including a spray nozzle for spraying liquid, an outlet conduit connected for delivering liquid to the spray nozzle, an inlet conduit for receiving liquid from a liquid supply, a pump connected between the inlet conduit and the outlet conduit and effective for pumping liquid from the inlet conduit to the outlet conduit, actuation means connected with the spray nozzle for selectively permitting or blocking exit from the spray nozzle of liquid pumped by the pump, a bypass conduit connected between the inlet conduit and the outlet conduit and in parallel with the pump, and a liquid bypass system associated with the bypass conduit for selectively closing and opening the bypass conduit to flow of liquid through the bypass conduit, the bypass system comprising:

a bypass chamber in liquid communication with the bypass conduit, the bypass chamber having a bypass chamber inlet in fluid communication with the outlet conduit for receiving liquid from the outlet conduit and having a bypass chamber outlet for delivering liquid through the bypass conduit to the inlet conduit;

a shuttle movable in the bypass chamber between a first position in which the shuttle blocks liquid communication between the bypass chamber and the bypass conduit and a second position which permits liquid communication between the bypass chamber and the bypass conduit;

the shuttle having a first end surface area in the bypass chamber which is exposed to liquid pressure at the chamber inlet and a second end surface area in the bypass chamber which is exposed to liquid pressure in the chamber outlet wherein the second end surface area is larger than the first end surface area;

a liquid passage which extends through the shuttle from the first end surface area to the second end surface area of the shuttle, the liquid passage being tapered in cross-section along substantially the entire distance from the first end surface area tot he second end surface area for producing in the bypass chamber a pressure drop across the shuttle from the first end surface area to the second end surface area when liquid is passing through the liquid passage, the pressure drop being such that the shuttle becomes disposed in the first position when liquid is passing through the liquid passage and out the spray nozzle during which time the liquid pressure at the chamber inlet is greater than the liquid pressure at the chamber outlet by a predetermined amount, and otherwise the shuttle is moved, by the liquid pressures at the chamber inlet and the chamber outlet, toward the second position; and biasing means at the bypass chamber for biasing the shuttle toward the second position.

2. The pressure washer of claim 1, wherein the shuttle has an axis along which the shuttle moves in the bypass chamber, and the liquid channel passes generally axially through the shuttle.

3. The pressure washer of claim 2, wherein the shuttle has a substantially circular cross-section.

4. The pressure washer of claim 2, further comprising first and second seals disposed axially spaced apart and extending circumferentially around the shuttle, the first seal being so placed with respect to the chamber inlet and the bypass conduit and the bypass chamber being so shaped and dimensioned as to seal the chamber inlet from the bypass conduit in the first position of the shuttle; and the second seal being so placed with respect to the chamber inlet and the bypass conduit and the bypass chamber being so shaped and dimensioned as to seal the chamber outlet from the bypass conduit in all positions of the shuttle.

5. The pressure washer of claim 4, wherein the bypass chamber has first, second and third axially extending axial regions; the first region being toward the chamber inlet and having a smaller cross-section, the second region being toward the chamber outlet and having a larger cross-section, and the third region being disposed between the first and the second regions;

the first seal extending around a portion of the shuttle which is movable into the first region and toward the third region of the chamber, and the second seal extending around another portion of the shuttle wherein the second seal is at all times in sealing and sliding contact with a wall surrounding the bypass chamber.

6. The pressure washer of claim 5, wherein the bypass conduit meets the bypass chamber in the third region thereof.

7. The pressure washer of claim 6, wherein the first position of the shuttle places the first seal in contact with the wall of the bypass chamber which defines the third region and the third region is so placed that the first seal blocks liquid communication from the bypass chamber to the bypass conduit when the shuttle is in the first position; and the second position of the shuttle places the first seal such that it is radially spaced from the wall of the bypass chamber defining the first region of the bypass chamber and is spaced in a manner for permitting liquid flow from the bypass chamber to the bypass conduit.

8. The pressure washer of claim 1, wherein the biasing means comprises a spring acting on the shuttle.

9. The pressure washer of claim 8, wherein the spring is in the bypass chamber and engages the shuttle to push it toward the second position and the spring is so placed and of a type to be tensioned as the shuttle is moved to the forward position.

10. The pressure washer of claim 4, wherein the liquid passage includes an upstream end that is toward the first surface area and a downstream end that is narrowed in cross-section relative to the upstream end.

11. A pressure washer for delivering liquid under pressure, the pressure washer comprising:

a spray nozzle for spraying liquid;

an outlet conduit connected for delivering liquid to the spray nozzle;

an inlet conduit for receiving liquid from a liquid supply;

a pump connected between the inlet conduit and the outlet conduit and effective for pumping liquid from the inlet conduit to the outlet conduit;

actuation means connected with the spray nozzle for selectively permitting or blocking exit form the spray nozzle of liquid pumped by the pump;

a bypass conduit connected between the inlet conduit and the outlet conduit and in parallel with the pump; and a liquid bypass system associated with the bypass conduit for selectively closing and opening the bypass conduit to flow of liquid through the bypass conduit, the bypass system including a bypass chamber in liquid communication with the bypass conduit, a bypass chamber inlet in fluid communication with the outlet conduit for receiving liquid from the outlet conduit and a bypass chamber outlet for delivering liquid through the bypass conduit to the inlet conduit;

a shuttle in and movable axially along the bypass chamber, the shuttle having an inlet side facing toward the entrance of liquid into the bypass chamber and having an outlet side facing toward the exit of liquid from the bypass chamber into the outlet conduit, the shuttle being so shaped and being movable in the bypass chamber between a first position in which the shuttle blocks fluid communication between the bypass chamber and the bypass conduit and a second position which permits fluid communication between the bypass chamber and the bypass conduit, the shuttle and the bypass chamber being sized so that a surface area of the shuttle inlet side is smaller than a surface area of the shuttle outlet side, for normally urging the shuttle to the second position when the pressure in the bypass chamber at the outlet side of the shuttle approaches the pressure in the bypass chamber at the inlet side of the shuttle;

a liquid passage having a length which extends through the shuttle from the inlet side to the outlet side, the passage being tapered over substantially the entire length thereof for creating a pressure drop across the shuttle when liquid flows from the spray nozzle and through the outlet conduit, and the surface areas of the inlet and outlet sides being so sized and the narrowed region of the liquid passage being of such cross-section that the pressure drop reduces the pressure at the outlet side of the shuttle as to cause the pressure at the inlet side of the shuttle to move the shuttle to the first position; and biasing means at the bypass chamber for biasing the shuttle toward the second position.

12. The pressure washer of claim 11, further comprising first and second seals disposed axially spaced apart and extending circumferentially around the shuttle, the first seal being so placed with respect to the chamber inlet and the bypass conduit and the bypass chamber being so shaped and dimensioned as to seal the chamber inlet from the bypass conduit in the first position of the shuttle; and the second seal being so placed with respect to the chamber inlet and the bypass conduit and the bypass chamber being so shaped and dimensioned as to seal the chamber outlet from the bypass conduit in all positions of the shuttle.

13. The pressure washer of claim 11, wherein the liquid passage includes an upstream end that is toward the first surface area and a downstream end that is toward the second surface area and is narrower in cross-section than the upstream end.

* * * * *